United States Patent [19]

Richey

[11] 4,101,157

[45] Jul. 18, 1978

[54] TOOL FOR FISHING AN OBJECT FROM A BORE HOLE

[76] Inventor: Vernon T. Richey, 1111 Blalock, Apt. 160, Houston, Tex. 77055

[21] Appl. No.: 814,197

[22] Filed: Jul. 11, 1977

[51] Int. Cl.[2] ..... E21B 31/02

[52] U.S. Cl. ..... 294/86.21; 166/240

[58] Field of Search ..... 166/99, 240; 294/86.2, 294/86.21, 86.3, 86.31, 86.32, 86.33

[56] References Cited

U.S. PATENT DOCUMENTS

| | | | |
|---|---|---|---|
| 1,816,207 | 7/1931 | Borgo et al. | 294/86.21 |
| 2,070,869 | 2/1937 | Sorensen | 294/86.31 |
| 2,250,440 | 7/1941 | Shannon | 294/86.21 |
| 2,687,323 | 8/1954 | Stohn | 294/86.21 |
| 3,420,305 | 1/1969 | Alexander et al. | 166/240 |
| 3,912,009 | 10/1975 | Davis, Jr. | 166/240 |

*Primary Examiner*—James A. Leppink
*Attorney, Agent, or Firm*—Guy E. Matthews

[57] ABSTRACT

A tool is disclosed which fishes an object from a bore hole. The tool uses a tubular body having an upper and lower end, fingers are mounted within the body for moving between an opened position and a closed position and a spring is mounted within the body to use the fingers toward the lower end of the body. The movement of the fingers between the opened and closed positions is controlled by a camming mechanism slidably mounted within the body, which uses a sleeve forming a cam face defining a recycling "J" slot grooves and a pin extending from the body into the groove to cause the sleeve to rotate. Lugs are mounted with the sleeve for nesting within slots formed in the body to limit movement of the pin within the stems of the "J" slotted grooves.

3 Claims, 9 Drawing Figures

Fig. 1B
Fig. 1A
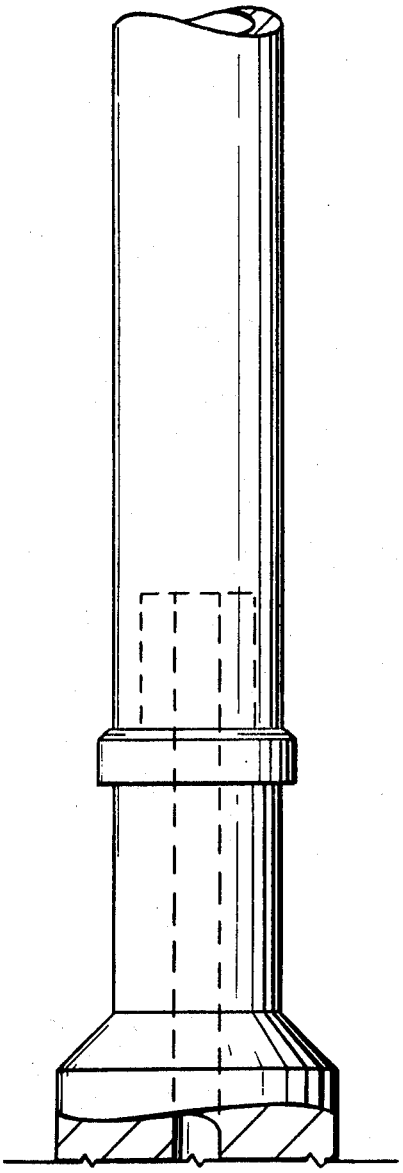
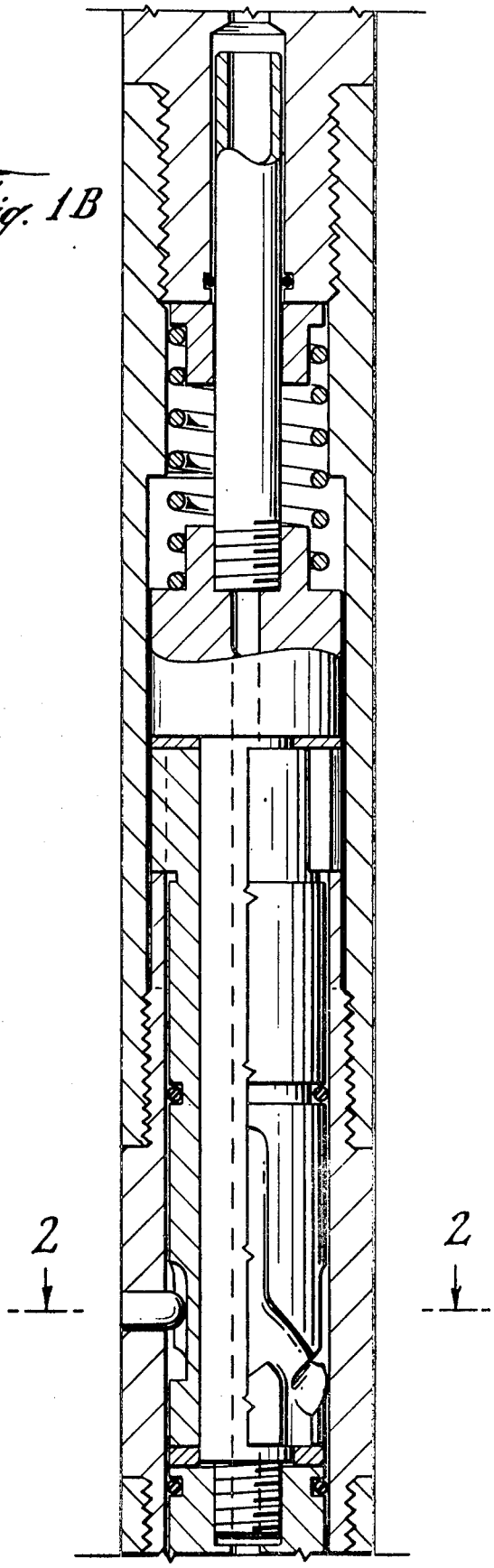

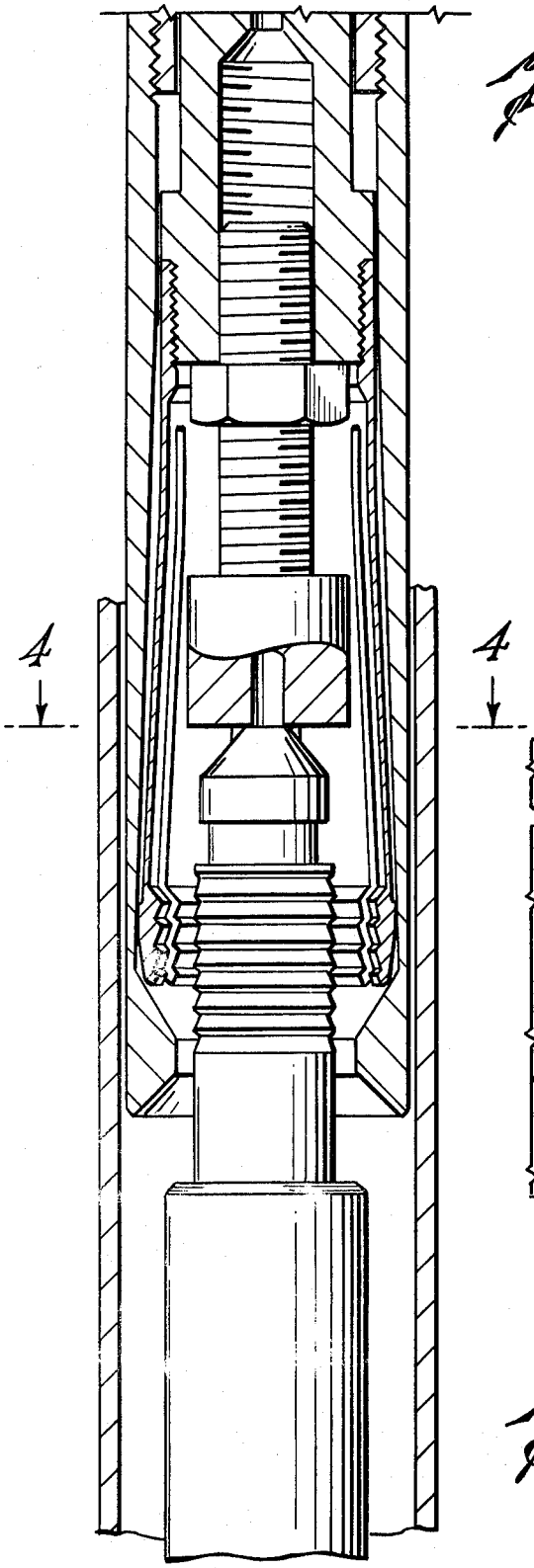
Fig. 1C
Fig. 2
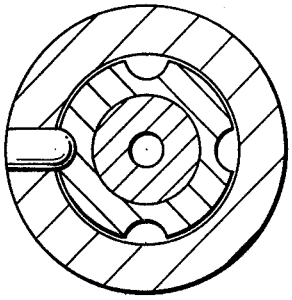
Fig. 3
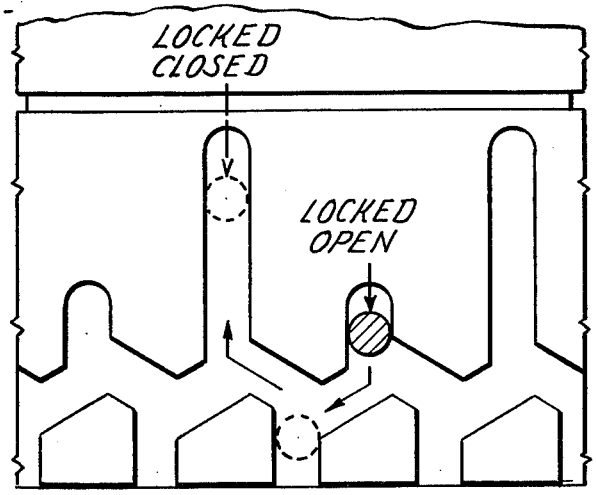
Fig. 4
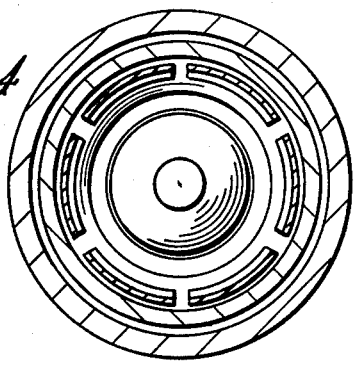

TOOL FOR FISHING AN OBJECT FROM A BORE HOLE

BACKGROUND AND SUMMARY

Tools used to fish objects from a bore hole are well known in the well drilling industry to remove the object from the bore hole and permit resumption of drilling or pumping operations. There are basically two types of these tools used, the spear and the overshot. The spear is lowered into the bore hole, engages the interior of the object and withdrawn from the hole with the object attached. The overshot is lowered into the bore hole, engages the exterior of the object and withdrawn from the hole with the object attached.

A relatively recent development in both types of these tool designs has been a tool that repetitiously moves between opened and closd positions. Thus, if the object is not grabbed on the first attempt, the tool is recycled for another attempt without withdrawing the tool from the bore hole. The overshot tools use a tubular body supporting fingers movable between the opened and closed positions. A spring is mounted within the body to urge the fingers toward the lower end of the body, which causes the fingers to move toward the closed position by coacting with a tapered surface located on the body. A camming mechanism is provided to control the movement of the fingers by using a sleeve rotatably mounted within the body which forms a cam face defining upwardly extending stems of "J" slotted grooves at the closed and opened positions of the fingers with connecting grooves between the "J" slotted grooves to create a single cam groove and permit recycling of the fingers between the opened and closed positions. Two pins extend from the body into and coact with the cam groove to cause the sleeve to rotate from the opened position to the closed position by moving the body toward and away from the object after engagement with a portion of the object. This action permits the pins to move up the stems of the "J" slotted groove and cause the spring to urge the fingers into the closed position or overcomes the urging of the spring to move the fingers into the opened position. Sometimes, the cam face of the sleeve defines a slot in the cam groove extending downwardly at each position between the upwardly extending stems of the "J" slotted grooves. This camming mechanism has created severe difficulties in these tools because the pins frequently strike the ends of the slots in the cam groove. Thus, the pins have a tendency to break within the cam groove and damage the cam face. The frequency of pin breakage increases as stronger springs are used, which is desired for providing a stronger gripping force by the fingers on the object. Further, this pin breakage can cause damage to the fingers because the fingers will extend downwardly past the end of the body after the pin breaks. In such condition, the fingers are jammed into the fish without the user knowing that the tool is not recycling.

Another problem existing in the construction of the prior art tools has to do with the difficulty in aligning two pins symmetrically within the body for coacting within the cam groove. Should the pins be misaligned, damage can occur very quickly to the groove or cam face. Also, such misalignment can cause failure of the pin with the above described results. Therefore, extreme care is used in constructing these tools, which makes fabrication costs quite expensive.

Accordingly, it is a primary object of this invention to provide an improved tool for fishing an object from a bore hole that aids in preventing damage to a pin used in the camming mechanism.

A further object of the present invention is to provide an improved tool for fishing an object from a bore hole that aids in preventing damage to the fingers used to grip the object.

A further object of the present invention is to provide an improved tool for fishing an object from a bore hole that permits the use of a stronger spring than used in the prior art fishing tools.

An additional object of the present invention is to provide an improved tool for fishing an object from a bore hole that employs a single pin in the camming mechanism.

In accordance with the invention, a tool for fishing an object out of a bore hole is disclosed. The tool has a tubular body with an upper end for connecting an apparatus extending from the earth's surface to raise and lower the tool in and out of the hole and a lower end for extending around and over a portion of the object, the lower end having a tapered surface located thereon. Fingers are mounted within the body for coacting with the tapered surface of the body to move between an opened position and a closed position with a spring being mounted within the body for urging the fingers toward the lower end of the body to coact with the tapered surface. A camming means is mounted within the body for controlling the movement of the fingers between the opened and closed positions by using a sleeve rotatably mounted within the body, which forms a cam face defining "J" slotted grooves with upwardly extending stems at the opened and closed positions of the fingers and connecting grooves between the "J" slotted grooves to form a single cam groove which permits recycling of the fingers between the opened and closed positions. The pin of the camming means extends from the body into and coacts with the cam groove to cause the sleeve to rotate between the opened and closed positions by moving the body toward and away from the object after engagement with a portion of the object, the fingers moving into the closed position by the urging of the spring and by the movement of the pin upward into the closed position stem of the "J" slotted grooves and the fingers moving into the opened position by overcoming the urging of the spring and by the movement of the pin upward into the opened position stem of the "J" slotted grooves. Lugs are mounted with the sleeve for nesting within corresponding slots formed in the body which define first shoulders between the slots and second shoulders at the bottom of the slots, the lugs have downwardly facing shoulders for abutting against the first shoulders to limit movement of the pin in the opened position stem of the "J" slotted grooves and for abutting against the second shoulders to limit movement of the pin in the closed position stem. The opening and closing of the fingers and movement of the lugs is caused by moving the body toward and away from the object which causes the first and second shoulders to move downwardly relative to the lugs and the pin to move downwardly within and coact with the cam groove for rotating the sleeve and lugs into alignment such that the downwardly facing shoulders of the lugs will abuttingly engage the respective first or second shoulders of the body.

BRIEF DESCRIPTION OF THE DRAWINGS

Other objects and advantages of the invention will become apparent upon reading the following detailed description and upon reference to the drawings, in which:

FIGS. 1A, 1B and 1C are elevational views, partly in section, of an overshot fishing tool embodying the present invention in the opened position.

FIG. 2 is a plan view taken along lines 2—2 of the embodiment of the invention shown in FIG. 1B.

FIG. 3 is a planar representation of a pin and groove cam mechanism usable with the present invention.

FIG. 4 is a plan view taken along lines 4—4 of the embodiment of the invention shown in FIG. 1C.

While the inventon will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Turning first to FIGS. 1A, 1B and 1C, a tool 10 for fishing an object 12 from a bore hole 14 is shown in the opened or disengaged position. Tool 10 is raised and lowered in and out of bore hole 14 by apparatus 16 extending from the earth's surface. Preferably, apparatus 16 is connected pipes to permit the passage of washing fluid to tool 10, as shown in dotted outline FIG. 1A, and therethrough for washing a portion of object 12 and thereby obtain a firmer grip on the object.

Figure 5A:
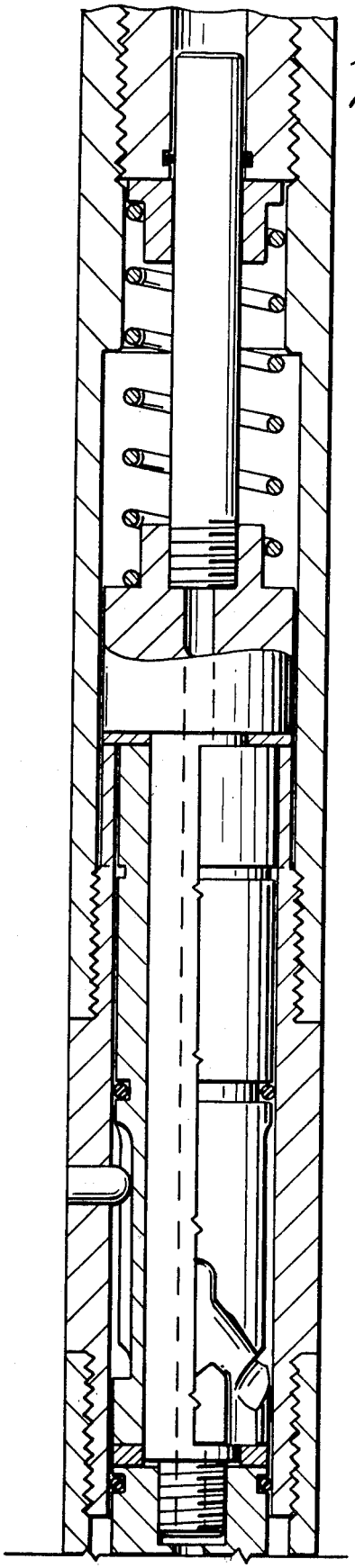
FIGS. 5A and 5B are elevational views, partly in section, of the embodiment of the invention shown in FIGS. 1A, 1B and 1C in the closed position.
Figure 5B:
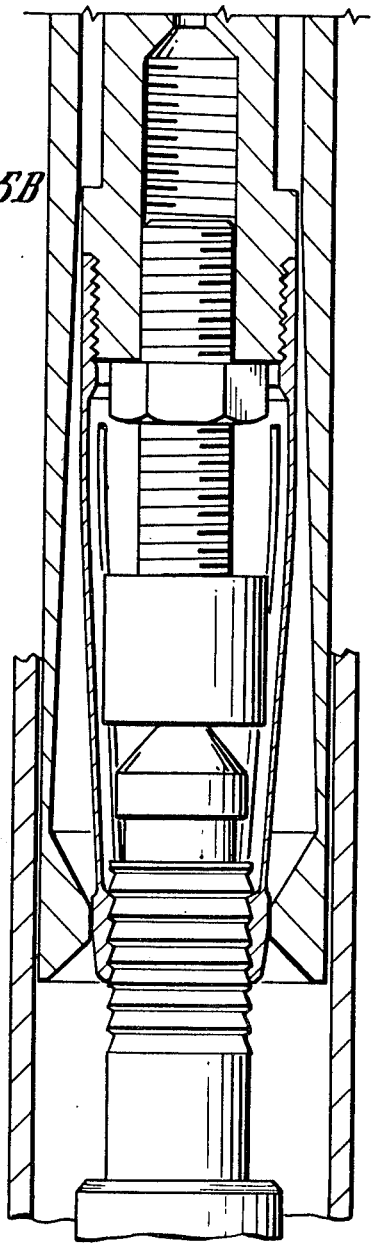

An elongated tubular body 18 is provided for tool 10 and has an upper end 20 for connecting to apparatus 16 and a lower end 22 for extending around and over a portion of object 12 with a tapered surface 24 located thereon. Preferably, as best shown in FIGS. 1A, 1B and 5A, body 18 has an upper end section 26, which incorporates a joint 28 in the upper portion for connecting tool 10 to apparatus 16, a first threaded male extension 30 to define first male threads and an aperture 32 extending down through upper end section 26 to permit the passage of the wash water. As best shown in FIGS. 1B and 5A, an intermediate tubular support section 34 is mounted with upper end section 26 by use of a first female threaded portion 36, defining first female threads, to threadably interconnect with first male threads 30 and has a second female threaded portion 38, defining second female threads, disposed in the lower portion of intermediate section 34. As best shown in FIGS. 1B, 2, 5A and 6, a camming mechanism tubular support section 40 is mounted with intermediate support section 34 by use of a second male threaded extension 42, defining second male threads, to threadably interconnect with second female threads 38 with slots 44 provided above the second male threads to define first upwardly facing shoulders 46 located between slots 44 and second upwardly facing shoulders 48 located at the bottom of slots 44 and, preferably, supports a single pin guide 50 below second male threads 42 and has a third male threaded extension 42, defining third male threads, at the lower end of camming mechanism support section 40 with a third shoulder 54, downwardly facing, defined by section 40. As best shown in FIGS. 1C and 5B, a tubular lower section 56 is mounted with camming mechanism support section 40 by using a third female threaded portion 58, defining third female threads, to threadably interconnect with third male threads 52 and has tapered surface 24 defined at the lower end thereof.

Extending down the interior of body 18 is a sliding mechanism 60, which permits movement of body 18 toward and away from object 12 after engagement with a portion of the object while preventing movement of mechanism 60 toward and away from the object. As best seen in FIGS. 1B, 1C, 5A and 5B, sliding mechanism 60 includes a conduit 62 sealingly mounted in upper section 26 for sliding movement within aperture 32, which is threadably connected to the head of a tubular bolt 64 extending into lower end section 56 for threadably connecting to a stop member 66 which engages the portion of object 12. A collet 68 is threadably connected to stop member 66 to mount fingers 70 within body 18 for coacting with tapered surface 24 to move between an opened position, FIGS. 1C and 4, and a closed position, FIG. 5B. As best seen in FIGS. 1B and 5A, a coil spring 72 is mounted within body 18 concentrically about conduit 62 against the head of tubular bolt 64 for urging fingers 70 toward lower end 22 of body 18.

As best seen in FIGS. 1B, 3 and 5A, a camming mechanism 74 is mounted within body 18 for controlling the movement of fingers 70 between the opened and closed positions. Camming mechanism 74 includes a sleeve 76 rotatably mounted within body 18 between the head and threads of tubular bolt 64. As shown in the planar view of FIG. 3, sleeve 76 has a cam face formed on the outside surface, which defines "J" slotted grooves 78 with upwardly extending stems located at the closed and opened positions of fingers 70 and gooves 80 connecting the "J" slotted grooves to form a single cam groove 82 for recycling fingers 70 between the opened and closed positions. Preferably, sleeve 86 has downwardly extending slots 84 from cam groove 82 at each midway position between the upwardly extending stems of "J" slotted grooves 78. Pin 50 extends from body 18 into and coacts with groove 82 to cause sleeve 76 to rotate from the opened and closed positions in cam groove 82. The rotation of sleeve 76 from the opened to the closed positions occurs by moving body 18 toward object 12 after engagement by stop member 66 with a portion of the object to cuase pin 50 to enter connecting groove 80 and rotate sleeve 76 to slot 84 and upon movement of body 18 away from object 12 to cause pin 50 to continue along connecting groove 80 for eventual entry of pin 50 into and movement up the closed position stem of "J" slotted grooves 78. This action allows spring 72 to continue urging fingers 70 toward lower end 22 of body 18 until fingers 70 coact with tapered surface 24 for movement of fingers 70 into the closed position. The rotation of sleeve 76 from the closed to the opened positions occurs by moving body 18 toward object 12 after engagement by stop member 66 with a portion of the object to cause pin 50 to leave the upwardly extending closed position stem of "J" slotted grooves 78 for movement along the base of "J" slotted grooves 78 and rotation of sleeve 76 to slot 84 and upon movement of body 18 away from object 12 to cause pin 50 to continue along the base of 37 J" slotted grooves 78 for eventual entry of pin 50 into and movement up the opened position stem of "J" slotted grooves 78. This action overcomes the urging of spring 72 toward lower end 22 of body 18 and retains fingers 70 within body 18 by an amount sufficient to prevent coaction with tapered surface 24, which retains fingers 70 in the opened position.

Figure 6:
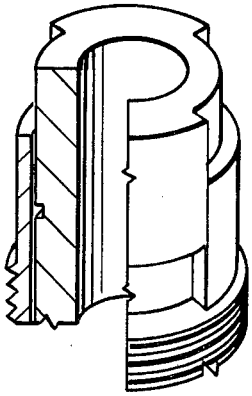
FIG. 6 is a perspective view of a portion of the illustrated embodiment used to limit the movement of the pin in the upwardly extending slots of the cam groove.

As best seen in FIGS. 1B, 5A and 6, lugs 86 are mounted at the upper end of sleeve 76 for nesting in corresponding slots 44 formed in body 18. Each lug 86 has a downwardly facing shoulder 88 to form abutting surfaces and movable between and against first shoulders 46 to limit movement of pin 50 in the opened position stem of "J" slotted goooves 78 and against second shoulders 48 to limit movement of pin 50 in the closed position stem of "J" slotted grooves 78. Preferably, stop member 66 includes a projection to form an upwardly facing shoulder 90 for abutting against third shoulder 54 to limit movement of pin 50 in downwardly extending slots 84. Thus, as body 18 is moved toward object 12 after stop member 66 engages a portion of the object, fingers 70 move between the opened and closed positions while holding lugs 86 a distance from object 12, first shoulder 46, second shoulder 48 and third shoulder 54 move downwardly relative to the lugs and pin 50 moves downwardly in and coacts with cam groove 82 to rotate sleeve 76 and align lugs 86 with the respective first and second shoulders while the upwardly facing shoulder 90 abutts against the third shoulder.

Thus, it is apparent that there has been provided, in accordance with the invention, a fishing tool that fully satisfies the objects, aims and advantages set forth above. While the invention has been described in conjunction with specific embodiments thereof, it is evident that many alternatives, modifications, and variations will be apparent to thoses skilled in the art in light of the foregoing description. Accordingly, it is intended to embrace all such alternatives, modifications and variations as fall within the spirit and broad scope of the appended claims.

What is claimed is:

1. A tool for fishing an object out of a bore hole, comprising:

(a) a tubular body having (i) an upper end for connecting to apparatus extending from the surface to raise and lower the tool in and out of the bore hole, (ii) a lower end for extending around and over a portion of the object, said lower end having a tapered surface located thereon;

(b) fingers mounted within said body for coacting with the tapered surface of said body to move between an opened position and a closed position;

(c) a spring mounted within said body for urging said fingers toward the lower end of said body for coaction with the tapered surface;

(d) camming means mounted within said body for controlling the movement of said fingers between the opened and closed positions having (i) a sleeve rotatably mounted within said tubular body forming a cam face defining "J" slotted grooves with upwardly extending stems located at the closed and opened positions of said fingers and connecting grooves between "J" slotted grooves thereby forming a single cam groove which permits recycling of said fingers between the opened and closed position, (ii) a pin extending from said tubular body into and coacting with the cam groove to cause the sleeve to rotate between the opened and closed positions by moving said body toward and away from the object after engagement with a portion of the object, the fingers moving into the closed position by the urging of the spring and by the movement of the pin upward into the closed position stem of the "J" slotted grooves and the fingers moving into the opened position by overcoming the urging of the spring and by movement of the pin upward into the opened position stem of the "J" slotted grooves; and (e) lugs mounted with said sleeve for nesting within corresponding slots formed in said body which defines first shoulders between the slots and second shoulders at the bottom of the slots, said lugs having downwardly facing shoulders for abutting against the first shoulders to limit movement of the pin in the opened position stem of the "J" slotted grooves and for abutting against the second shoulders to limit movement of the pin in the closed position stem, the opening and closing of the fingers and movement of the lugs being provided by movement of said body toward and away from the object after engagement with a portion of the object, which causes the first and second shoulders to move downwardly relative to the lugs and the pin to move downwardly within and coact with the cam groove for rotating the sleeve and lugs into alignment such that the downward facing shoulders of the lugs will abuttingly engage with the respective first or second shoulders of said body.

2. The fishing tool of claim 1, wherein only a single pin is used in said camming means.

3. The tool of claim 1, wherein the cam face of said sleeve defines a slot extending downwardly at each position along the cam groove between the upwardly extending stems of the "J" slotted grooves to become a part of the cam groove; and a projection mounted with said sleeve having an upward facing shoulder for abutting against a third shoulder formed in said body to limit movement of the pin in the downwardly extending slots.

* * * * *